US008855530B2

(12) United States Patent
Sato

(10) Patent No.: US 8,855,530 B2
(45) Date of Patent: Oct. 7, 2014

(54) IMAGE FORMING APPARATUS HAVING PHOTOSENSITIVE DRUM MOVING MECHANISM

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 121 days.

(21) Appl. No.: 13/432,536

(22) Filed: Mar. 28, 2012

(65) Prior Publication Data

US 2012/0328326 A1 Dec. 27, 2012

(30) Foreign Application Priority Data

Jun. 27, 2011 (JP) ..... 2011-141600

(51) Int. Cl.
*G03G 15/00* (2006.01)
*G03G 21/16* (2006.01)
*G03G 21/18* (2006.01)

(52) U.S. Cl.
CPC ..... *G03G 21/1623* (2013.01); *G03G 21/1647* (2013.01); *G03G 21/1842* (2013.01)
USPC ..... 399/110; 399/107

(58) Field of Classification Search
USPC ..... 399/107, 110, 111
See application file for complete search history.

(56) References Cited

U.S. PATENT DOCUMENTS

| | | | | |
|---|---|---|---|---|
| 7,664,428 | B2 | 2/2010 | Kei | |
| 2009/0092412 | A1 | 4/2009 | Kei | |
| 2009/0142092 | A1 * | 6/2009 | Sato | 399/111 |
| 2010/0166462 | A1 * | 7/2010 | Igarashi | 399/155 |
| 2012/0328325 | A1 | 12/2012 | Sato | |
| 2012/0328327 | A1 | 12/2012 | Sato | |

FOREIGN PATENT DOCUMENTS

| | | |
|---|---|---|
| JP | 2009-092914 | 4/2009 |
| JP | 2010-244071 | 10/2010 |

* cited by examiner

*Primary Examiner* — David Gray
*Assistant Examiner* — Thomas Giampaolo, II
(74) *Attorney, Agent, or Firm* — Banner & Witcoff, Ltd.

(57) ABSTRACT

Each of a plurality of pressing portions presses a pressed portion of corresponding one of a plurality of photosensitive drums. The moving member is configured to be moved between a contact position and a separated position when the retaining unit is in an internal position. Each of the plurality of pressing portions exerts upward pressure on the corresponding one of the plurality of photosensitive drums to bring the corresponding one of the plurality of photosensitive drums into contact with the endless belt when the moving member is in the contact position. Each of the plurality of pressing portions releases the upward pressure on the corresponding one of the plurality of photosensitive drums to separate the corresponding one of the plurality of photosensitive drums from the endless belt when the moving member is in the separated position. The moving member is provided on the retaining unit.

22 Claims, 9 Drawing Sheets

IMAGE FORMING APPARATUS HAVING PHOTOSENSITIVE DRUM MOVING MECHANISM

CROSS REFERENCE TO RELATED APPLICATION

This application claims priority from Japanese Patent Application No. 2011-141600 filed Jun. 27, 2011. The entire content of the priority application is incorporated herein by reference.

TECHNICAL FIELD

The present invention relates to an image forming apparatus such as a color laser printer.

BACKGROUND

As an electro-photographic type color laser printer, a tandem type color laser printer is known in which a plurality of photosensitive drums are juxtaposed with each other for the color of yellow, magenta, cyan and black.

In a conventional tandem type color laser printer, a belt unit having an endless belt is provided and a plurality of photosensitive drums juxtaposed with each other is positioned above and in contact with the endless belt.

According to the conventional color printer, each process cartridge accommodating each photosensitive drum is detachably attached to a cartridge tray. The cartridge tray is inserted into an interior of a main casing of the printer while a door is opened, and is positioned above the endless belt. Then, a pressure member positioned above each process cartridge is pivotally moved downward in interlocking relation to the closing movement of the door. The main casing has a positioning portion for positioning the process cartridges relative to the endless belt and the main casing as a result of pressure application from the pressure members. Thus, each pressure member presses each process cartridge downward whereupon each photosensitive drum is brought into contact with the endless belt, and positioning of each photosensitive drum with respect to the endless belt and the main casing is attained.

Japanese Patent Application Publication 2010-244071 discloses a tandem type color printer in which photosensitive drums are positioned below an intermediate transfer belt in a form of an endless belt, and each photosensitive drum is configured to contact the intermediate transfer belt.

According to the color printer disclosed in '071 publication, a plurality of process cartridges each accommodating each photosensitive drum are positioned below the belt unit. Each photosensitive drum has an upper peripheral part exposed to the intermediate transfer belt through each process cartridge. Thus, each photosensitive drum is in contact with the intermediate transfer belt from below.

SUMMARY

In the tandem type color printer in which the photosensitive drums are positioned below the endless belt, the process cartridges must be lifted upward for positioning against gravity when the pressure member is used for pressing the process cartridge. Hence, if a pressuring region of the pressure member for pressing the process cartridge is remote from the belt in a vertical direction, a contact region and positioning of the photosensitive drum with respect to the belt may become instable. Such instability may be accelerated by external factor such as vibration and friction with the belt during image forming operation, and consequently, blur of output image may occur.

In view of the foregoing, it is an object of the present invention to provide an image forming apparatus capable of bringing a photosensitive drum into stable contact with a belt or a positioning portion provided in a main casing even if the photosensitive drum is positioned below a belt unit.

In order to attain the above and other objects, the present invention provides an image forming apparatus including a main casing, a retaining unit, an endless belt, and a moving member. The retaining unit is configured to retain a plurality of photosensitive drums juxtaposedly arrayed with and spaced away from each other in a predetermined direction. The retaining unit is movable in the predetermined direction between an internal position in which the retaining unit is located inside the main casing and an external position outside of the main casing, each of the plurality of photosensitive drums being movably supported on the retaining unit in a vertical direction and including a pressed portion. The endless belt is disposed above the retaining unit that is in the internal position. The moving member includes a plurality of pressing portions. Each of the plurality of pressing portions presses the pressed portion of a corresponding one of the plurality of photosensitive drums. The moving member is configured to be moved between a contact position and a separated position when the retaining unit is in the internal position. Each of the plurality of pressing portions exerts upward pressure on the corresponding one of the plurality of photosensitive drums to bring the corresponding one of the plurality of photosensitive drums into contact with the endless belt when the moving member is in the contact position. Each of the plurality of pressing portions releases the upward pressure on the corresponding one of the plurality of photosensitive drums to separate the corresponding one of the plurality of photosensitive drums from the endless belt when the moving member is in the separated position. The moving member is provided on the retaining unit.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
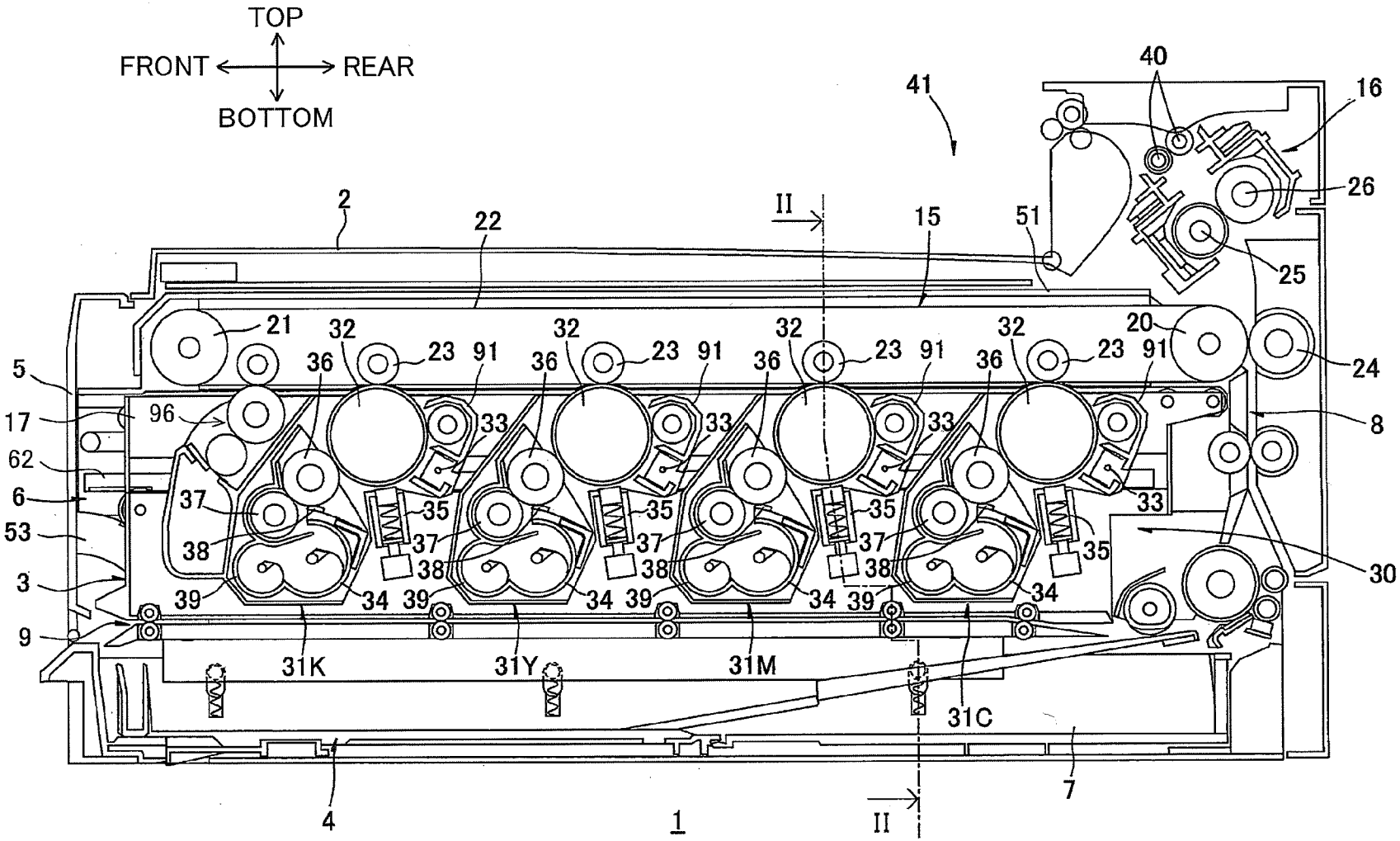
FIG. 1 is a cross-sectional side view of a color printer according to a first embodiment of the present invention.

An image forming apparatus according to a first embodiment of the present invention will be described while referring to FIGS. 1 through 7 wherein like parts and components are designated by the same reference numerals to avoid duplicating description.

1. Overall Structure of Color Printer

As shown in FIG. 1, the image forming apparatus according to the first embodiment is a horizontal intermediate transfer type color printer 1.

The color printer 1 includes a main casing 2 having an inner casing 51 for retaining an image forming unit 3 therein. Within the main casing 2, the image forming unit 3 and a sheet supply unit 4 are provided. The sheet supply unit 4 serves to supply sheets of paper P to the image forming unit 3.

(1) Main Casing

The main casing 2 has a box shape that is substantially rectangular in a side view. The main casing 2 has a front wall in which an opening 6 is formed. The opening 6 provides communication between the interior and exterior of the main casing 2. A front cover 5 is provided on the front wall so as to be pivotally movable about a lower end thereof. The front cover 5 is movable between a closed position and an open position. In the open position, an upper end of the front cover 5 is spaced apart from the main casing 2 and opens the opening 6, while, in the closed position, the upper end of the front cover 5 is in abutment with the main casing 2 and closes the opening 6.

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 5 is provided (left side in FIG. 1) will be referred to as the front side of the color printer 1, and a side opposite to the front side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 4 includes a sheet supply tray 7 for accommodating sheets of paper P therein. The sheet supply tray 7 is disposed at a bottom section of the main casing 2. The sheet supply tray 7 is detachably mounted in the main casing 2. A sheet supply path 8 is defined in the main casing 2. The sheet supply path 8 extends from a rear portion of the sheet supply tray 7 toward the image forming unit 3 (i.e. toward a position between a belt unit 15 (described later) and a secondary transfer roller 24 (described later)).

After the sheets P accommodated in the sheet supply tray 7 are separated by various rollers on a sheet-by-sheet basis, each separated sheet P is conveyed to the sheet supply path 8. While being guided by the sheet supply path 8, the sheet P is conveyed to the image forming unit 3.

The sheet supply unit 4 also defines a manual sheet supply path 9. The manual sheet supply path 9 defines a passage between the sheet supply tray 7 and the image forming unit 3 for guiding the sheet P extending in a frontward/downward direction.

The sheet P inserted into the manual sheet supply path 9 from a front side of the main casing 2 is conveyed along the manual sheet supply path 9 toward a rear portion of the main casing 2. After being conveyed to the sheet supply path 8 from the manual sheet supply path 9, the sheet P is conveyed to the image forming unit 3 along the sheet supply path 8.

(3) Image Forming Unit

The image forming unit 3 is disposed above the sheet supply unit 4. The image forming unit 3 includes a process unit 17, a belt unit 15, and a fixing unit 16.

(3-1) Process Unit

Within the main casing 2, the process unit 17 is disposed in an accommodating region 30 defined below the belt unit 15 and above the sheet supply unit 4.

The process unit 17 retains four process cartridges 31 corresponding to each color therein. Further, the process unit 17 is slidably movable in the frontward/downward direction between an internal position (FIGS. 1 and 5) in which the process unit 17 is positioned in the accommodating region 30 and an external position (FIG. 4) in which the process unit 17 is pulled outward of the main casing 2 when the front cover 5 is in the open position.

Four process cartridges 31 are juxtaposedly arrayed with and spaced apart from each other in the frontward/downward direction. More specifically, a black process cartridge 31K, a yellow process cartridge 31Y, a magenta process cartridge 31M, and a cyan process cartridge 31C are aligned in this order from front to rear.

Further, each process cartridge 31 includes a photosensitive drum 32, a Scorotron charger 33, and a developing unit 34.

The photosensitive drum 32 is cylindrical in shape extending in a rightward/leftward direction. The photosensitive drum 32 is rotatably supported to the process cartridges 31.

The Scorotron charger 33 is disposed diagonally below and rearward of the corresponding photosensitive drum 32, and confronts but does not contact the photosensitive drum 32.

The developing unit 34 is disposed diagonally below and frontward of the corresponding photosensitive drum 32. The developing unit 34 includes a developing roller 36.

The developing roller 36 is rotatably supported in an upper end of the corresponding developing unit 34. An upper rear edge of the developing roller 36 is exposed through an upper edge of the developing unit 34 and contacts the corresponding photosensitive drum 32 from below.

The developing unit 34 also includes a supply roller 37 for supplying toner to the corresponding developing roller 36 and a thickness-regulating blade 38 for regulating the thickness of the toner supplied to the developing roller 36. Further, the developing unit 34 includes a toner accommodating portion 39 for accommodating toner for a corresponding color therein. The toner accommodating portion 39 is disposed below the supply roller 37.

Further, the process unit 17 is provided with four LED units 35 in one-to-one correspondence with the four process cartridges 31.

The LED unit 35 is disposed rearward of the corresponding developing unit 34. Further, the LED unit 35 confronts the corresponding photosensitive drum 32 from below. The LED unit 35 is adapted to expose a surface of the corresponding photosensitive drum 32 based on image data.

Each LED unit 35 includes an LED array accommodating portion 46 and an LED array 45.

Figure 2A:
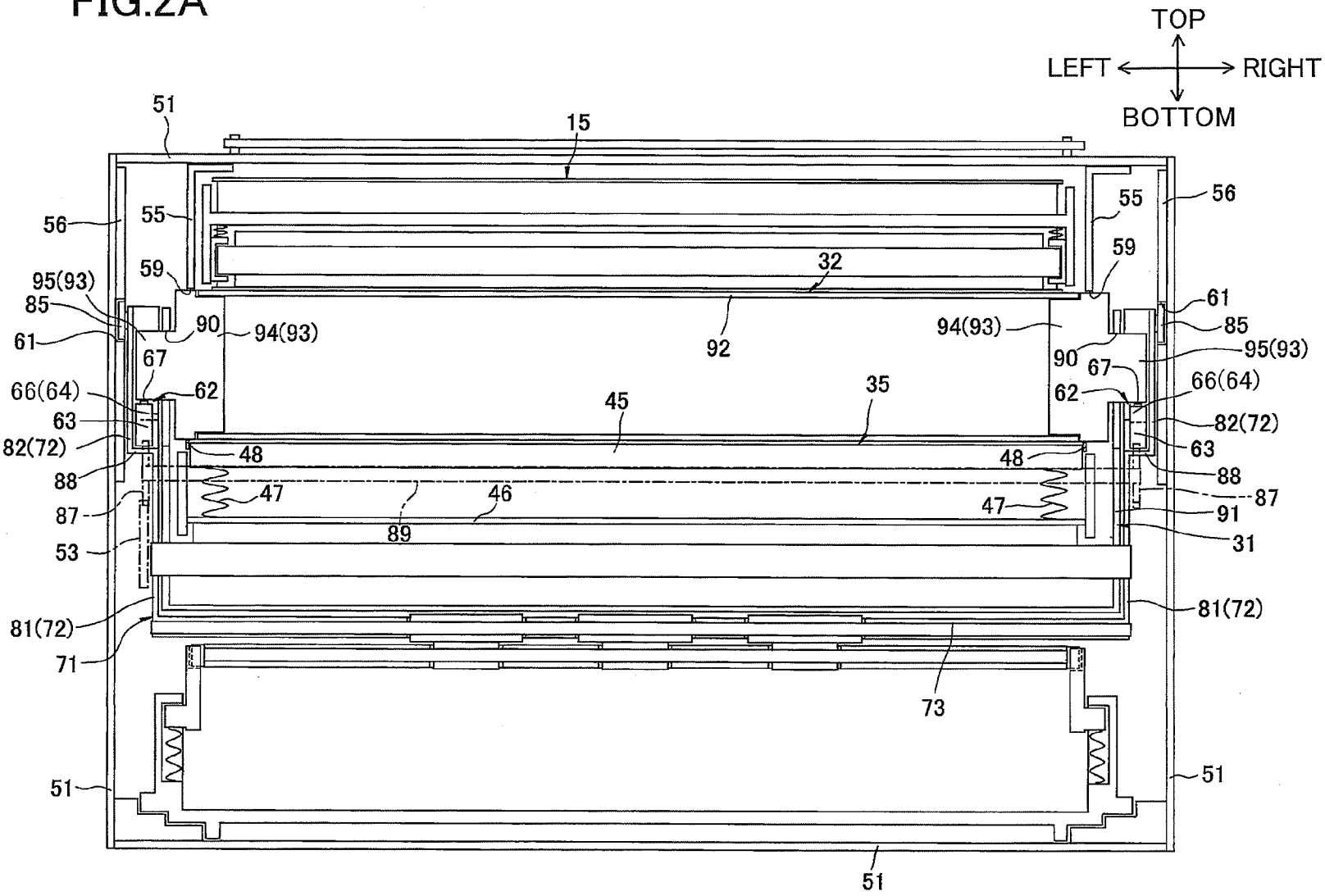
FIG. 2A is a cross-sectional view of the color printer shown in FIG. 1 along a line II-II in FIG. 1.

As shown in FIG. 2A, the LED array accommodating portion 46 is formed in a generally rectangular frame shape having a bottom wall and elongated in the rightward/leftward direction.

The LED array 45 is formed in an elongated beam shape extending in the rightward/leftward direction. The LED array 45 integrally retains a plurality of LEDs arrayed in the rightward/leftward direction. The LED array 45 has a lower portion that is accommodated in an upper portion of the LED array accommodating portion 46. The LED array 45 is movable relative to the LED array accommodating portion 46. The LED array 45 is resiliently supported to the bottom wall of the LED array accommodating section 46 by a pair of right and left compression springs 47 positioned between the bottom wall of the LED array accommodating portion 46 and the LED array 45.

The LED array 45 has right and left ends, each having an LED positioning member 48 for positioning the LED array 45 relative to the corresponding photosensitive drum 32.

Each LED positioning member 48 is formed in a plate shape that is substantially rectangular in a side view. The LED positioning members 48 are arranged to slightly protrude upward from the respective right and left edges of the LED array 45.

The LED positioning members 48 are urged upward by the compression springs 47, thereby contacting the corresponding photosensitive drum 32 from below. Hence, The LED array 45 is subjected to positioning relative to the photosensitive drum 32 such that the LED array 45 is in confrontation with the photosensitive drum 32 at a regular interval therebetween (at a distance corresponding to a protruding length of the LED positioning members 48) even if the photosensitive drum 32 is moved in a upward/downward direction as will be described later.

(3-2) Belt Unit

As shown in FIG. 1, the belt unit 15 is disposed in a topmost portion of the main casing 2.

The belt unit 15 includes a drive roller 20, a follow roller 21, an intermediate transfer belt 22, and four primary transfer rollers 23.

The drive roller 20 and the follow roller 21 are in confrontation with and spaced apart from each other in the frontward/rearward direction.

The intermediate transfer belt 22 is an endless belt. The intermediate transfer belt 22 is stretched around the drive roller 20 and the follow roller 21. When the drive roller 20 is driven to rotate, the intermediate transfer belt 22 circulates such that a lower portion of the intermediate transfer belt 22 moves in a rearward direction.

The primary transfer rollers 23 are juxtaposed with and spaced apart from each other in the frontward/rearward direction. The primary transfer rollers 23 are disposed so as to confront the corresponding photosensitive drum 32 with the lower portion of the intermediate transfer belt 22 interposed therebetween.

The secondary transfer roller 24 is disposed rearward of the belt unit 15.

The secondary transfer roller 24 confronts the drive roller 20 of the belt unit 15 with interposing the intermediate transfer belt 22 therebetween.

(3-2) Fixing Unit

The fixing unit 16 is disposed above the secondary transfer roller 24.

The fixing unit 16 includes a heating roller 25 and a pressure roller 26 in confrontation with the heating roller 25.

(3-3) Image Forming Operations (3-3-1) Developing Operation

The toner accommodated in the toner accommodating section 39 of the developing unit 22 is supplied to the supply roller 37, and then to the developing roller 36.

As the developing roller 36 rotates, the thickness-regulating blade 38 regulates the toner carried on the surface of the developing roller 36 to a prescribed thickness, so that the developing roller 36 carries a uniform thin layer of toner thereon. The toner supplied to the developing roller 36 is positively tribocharged between the thickness-regulating blade 38 and the developing roller 36.

In the meantime, the Scorotron charger 33 applies uniform charge of positive polarity to a surface of the corresponding photosensitive drum 32 as the photosensitive drum 32 rotates. Subsequently, the LED unit 35 exposes the surface of the corresponding photosensitive drum 32. An electrostatic latent image corresponding to an image to be formed on the sheet P is formed on the surface of the photosensitive drum 32.

As the photosensitive drum 32 continues to rotate, the positively charged toner carried on the surface of the developing roller 36 is supplied to the electrostatic latent image formed on the surface of the photosensitive drum 32, thereby developing the electrostatic latent image into a visible toner image through reverse development. Thus, the toner image is formed on the surface of the photosensitive drum 32.

(3-3-2) Transfer and Fixing Operations

The toner image formed on the surface of each photosensitive drum 32 through reverse development is primary-transferred onto the lower portion of the intermediate transfer belt 22 conveyed rearward, thereby forming a color image on the intermediate transfer belt 22.

When the color image formed on the intermediate transfer belt 22 reaches a confronting position where the intermediate transfer belt 22 confronts the secondary transfer roller 24 in association with circular movement of the intermediate transfer belt 22, the sheet P is supplied to the confronting position from the sheet supply unit 4 (alternatively, the manual sheet supply path 9) at a suitable timing of movement of the color image. As the intermediate transfer belt 22 continues to circularly move, the color image formed on the intermediate transfer belt 22 is secondary-transferred onto the sheet P.

The color image transferred onto the sheet P is thermally fixed to the sheet P by heat and pressure in the fixing unit 16, while the sheet P passes between the heating roller 25 and the pressure roller 26.

(4) Discharge

After the color image has been fixed to the sheet P in the fixing unit 16, the sheet P is discharged by discharge rollers 40 onto a discharge tray 41 formed on a top surface of the main casing 2.

2. Main Casing (1) Front Cover

The front cover 5 has an inner surface on which an interlocking member 53 is provided. When the front cover 5 is in the closed position, the interlocking member 53 is disposed at a left end portion of a substantially vertical center portion of the front cover 5.

Figure 3:
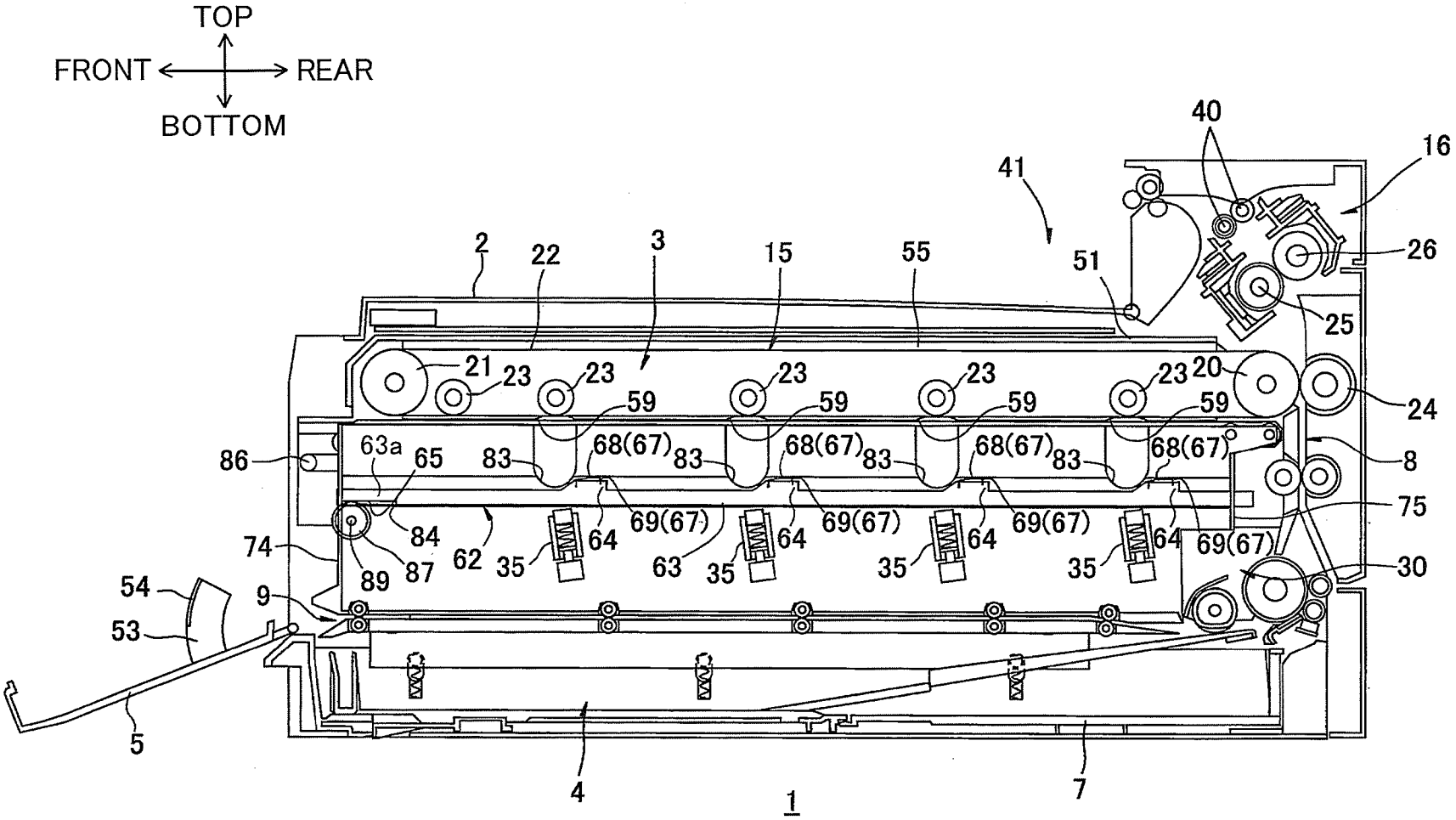
FIG. 3 is a cross-sectional side view of the color printer shown in FIG. 1, illustrating a linearly movable cam.

The interlocking member 53 extends diagonally rearward and downward from the inner surface of the front cover 5 and is formed in a generally arcuate shape in a side view having a middle portion protruding rearward. As shown in FIG. 3, the interlocking member 53 has an upper portion provided with first gear teeth 54 at a position between a middle portion and a free end thereof.

(2) Details of Main Casing

As shown in FIG. 2A, within the main casing 2, the inner casing 51 is provided. The inner casing 51 is formed in a box-shape and made of a material having high rigidity, such as a steel plate. Further, within the inner casing 51, a pair of right and left first frames 55 and a pair of right and left second frames 56 are provided.

(2-1) First Frame

The pair of first frames 55 is disposed at an upper portion of the main casing 2. The right first frame 55 is disposed at a right side of the belt unit 15 and the left first frame 55 is disposed at a left side of the belt unit 15. Each first frame 55 is formed in a generally rectangular flat plate shape and elongated in the frontward/rearward direction.

The pair of first frames 55 is arranged spaced apart from each other with the belt unit 15 interposed therebetween such that the pair of first frames 55 confronts each photosensitive drum 32 in the upward/downward direction at a position outside of a sheet contacting region of each photosensitive drum 32 in the rightward/leftward direction. (Here, the sheet contacting region implies a region of the photosensitive drum 32 where the sheet P contacts.) Each first frame 55 has an upper end portion fixed to a top wall of the inner casing 51.

Each first frame 55 has a lower portion in which four drum positioning recesses 59 (FIG. 3) in one-to-one correspondence with the four photosensitive drum 32.

Each drum positioning recess 59 is a substantially U-shaped notch having a bottom open. More specifically, the drum positioning recess 59 is depressed upward from a lower edge of the first frame 55. The four drum positioning recesses 59 are arranged juxtaposed with and spaced apart from each other in the frontward/rearward direction. Upper portions of right and left ends of the photosensitive drum 32 are supported in the drum positioning recesses 59 formed in the right and left first frames 55.

(2-2) Second Frame

Each of the right and left second frames 56 is formed in a flat plate shape extending in the frontward/rearward direction along right and left side plates of the inner casing 51. Further, each second frame 56 extends in the upward/downward direction from a position of the upper end portion of the first frame 55 toward a position lower than the photosensitive drum 32.

Each second frame 56 is formed with a guide groove 61 for guiding sliding movement of the process unit 17.

The guide groove 61 has a sufficient vertical length capable of receiving rollers 85 (described later) provided at the process unit 17. The guide groove 61 extends linearly in the frontward/rearward direction and is formed across substantially the entire frontward/rearward length of the second frame 56.

The guide groove 61 has a front end portion provided with a retaining portion (not shown) having a vertical length smaller than a diameter of the roller 85.

3. Process Unit

The process unit 17 includes a process frame 71 for integrally retaining the plurality of process cartridges 31 and the plurality of LED units 35 therein.

(1) Process Frame

Figure 5:
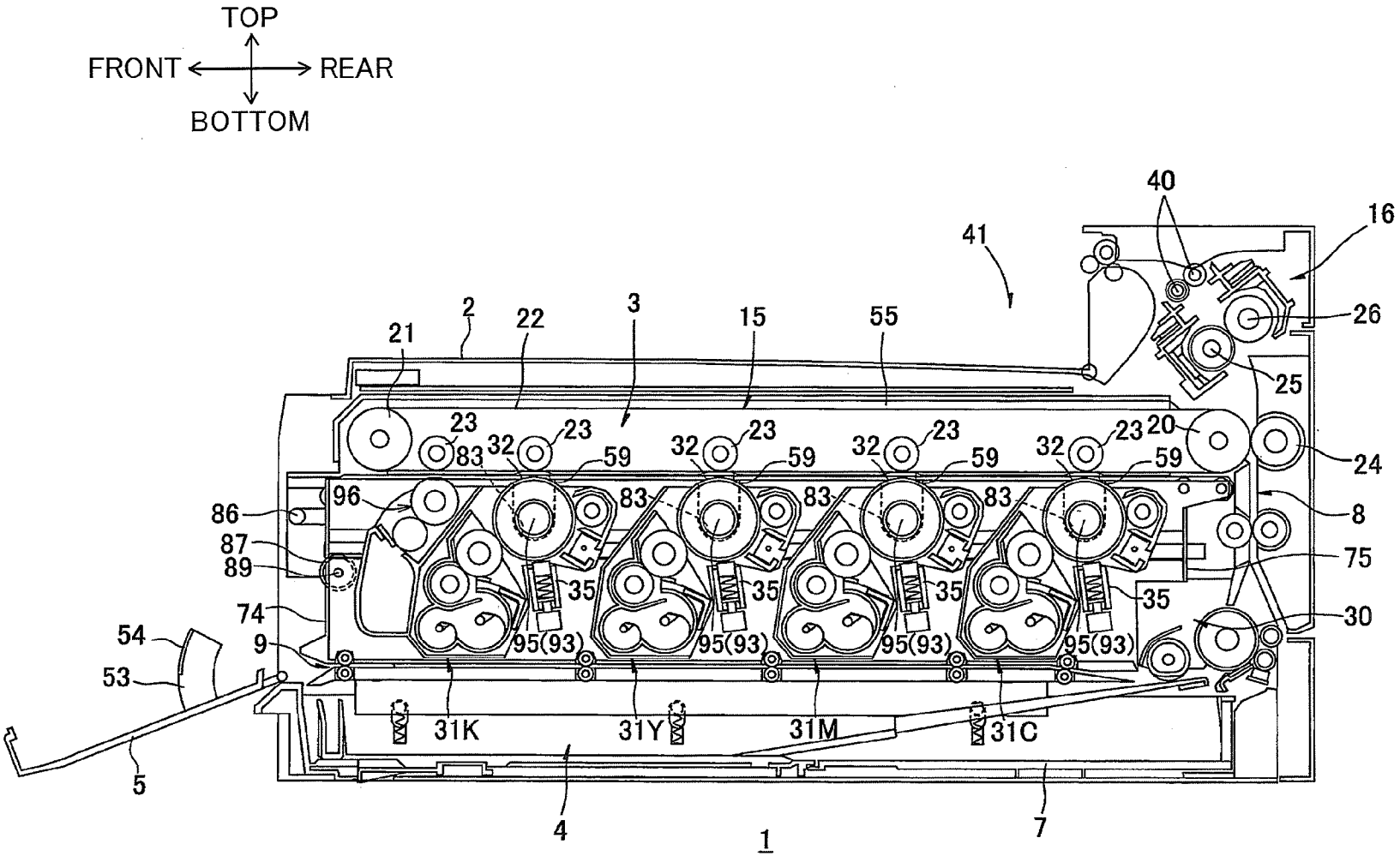
FIG. 5 is a cross-sectional side view of the color printer shown in FIG. 1, illustrating a mounting operation of the process unit in a main casing.

As shown in FIGS. 2A and 5, the process frame 71 is formed in a generally rectangular frame shape with a bottom wall. The process frame 71 has a pair of right and left side plates 72, a bottom plate 73, and a front plate 74, and a rear plate 75. The pair of side plates 72, the bottom plate 73, the front plate 74, and the rear plate 75 are integral with one another. The side plates 72 are arranged in confrontation with and spaced apart from each other in the rightward/leftward direction. The bottom plate 73 bridges between lower edges of the side plates 72. The front plate 74 bridges between front edges of the side plates 72. The rear plate 75 bridges between rear edges of the side plates 72.

Each of the side plates 72 includes a first side plate 81, a second side plate 82, and a support portion 88.

The first side plate 81 is formed in a flat plate shape extending in the frontward/rearward direction and in the upward/downward direction. The first side plate 81 is formed with four shaft supporting notches 83 at positions corresponding to the four photosensitive drums 32 supported to the respective process cartridges 31. Each shaft supporting notch 83 is formed in a substantially U-shape having a top open. More specifically, the shaft supporting notch 83 is depressed downward from an upper edge of the first side plate 81 (FIG. 2B).

The second side plate 82 is formed in a flat plate shape extending in the frontward/rearward direction and in the upward/downward direction. The second side plate 82 confronts an upper portion of the first side plate 81 in the rightward/leftward direction and is positioned laterally outward of the first side plate 81. More specifically, the second side plate 82 has a frontward/rearward length substantially equal to that of the first side plate 81. Further, the second side plate 82 has a vertical length smaller than that of the first side plate 81. Further, the second side plate 82 has an upper edge in flush with an upper edge of the first side plate 81 in the upward/downward direction and has a lower edge positioned downward of a lower edge of the shaft supporting notch 83.

Further, the side plate 72 is provided with a plurality of connecting plates 80 for connecting the first side plate 81 and the second side plate 82. Four sets of two connecting plates 80 are provided at positions corresponding to the four shaft supporting notches 83 formed in the first side plate 81. Each connecting plate 80 is formed in a flat plate shape. One of the two connecting plates 80 in each set extends in the upward/downward direction and in the rightward/leftward direction along a front portion of the corresponding shaft supporting notch 83, while remaining one of the two connecting plates 80 in each set extends in the upward/downward direction and in the rightward/leftward direction along a rear portion of the corresponding shaft supporting notch 83. Each connecting plate 80 has a lower edge positioned upward of the lower edge of the shaft supporting notch 83.

Figure 2B:
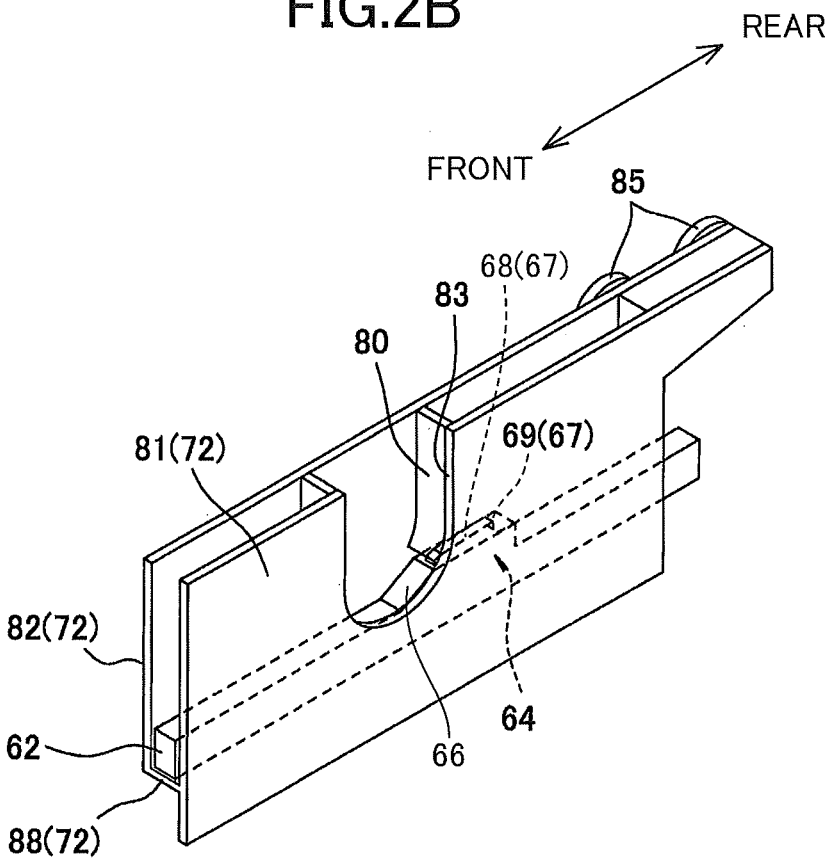
FIG. 2B is a perspective view of an essential portion of a process unit of the color printer shown in FIG. 1.

Further, the rollers 85 are supported to the second side plate 82 (FIG. 2B). More specifically, roller shafts (not shown) extend laterally outward from a laterally outer surface of the second side plate 82 at an upper rear end portion thereof, and the rollers 85 are rotatable about the roller shafts.

The support portion 88 is flat plate shaped and extends laterally from the lower edge of the second side plate 82 toward the first side plate 81. A linearly movable cam 62 is placed on the support portion 88.

Although not shown in FIGS. 2A and 2B, the support portion 88 has a front end positioned rearward of a front end of the first side plate 81 as well as a front end of the second side plate 82, thereby forming an opening 84 (FIG. 3) between the front end of the first side plate 81 and the front end of the second side plate 82 for exposing the front end portion of the linearly movable cam 62 therethrough.

Further, each side plate 72 includes two flat-plate shaped connection plates (not shown), one for connecting the front end of the first side plate 81 and the front end of the second side plate 82, and another for connecting a rear end of the first side plate 81 and a rear end of the second side plate 82.

A connection shaft 89 bridges between the pair of side plates 72 and extends in the rightward/leftward direction. The connection shaft 89 has right and left ends, each penetrating an upper front portion of the first side plate 81 and protruding laterally outward from the first side plate 81.

A disk-shaped interlocking gear 87 is non-rotatably supported to each of the right and left ends of the connection shaft 89 (a portion protruding laterally outward from the first side plate 81). The left interlocking gear 87 is positioned such that the interlocking member 53 of the front cover 5 is capable of confronting the interlocking gear 87 in the upward/downward direction. The interlocking gear 87 has an upper portion positioned between the first side plate 81 and the second side plate 82 through the opening 84. The right interlocking gear 87 is arranged in confrontation with the left interlocking gear 87 in the rightward/leftward direction. Each of the right and left interlocking gears 87 are non-rotatable relative to the connection shaft 89. Hence, when one of the right and left interlocking gears 87 rotates, remaining one of the right and left interlocking gears 87 also rotates via the connection shaft 89 in a direction in which the one of the right and left interlocking gears 87 rotates.

The front plate 74 is provided with a generally U-shaped handle 86. The handle 86 has free ends that are connected to a front surface of the front plate 74 and has a portion between the free ends that extends frontward.

The front plate 74 is formed with two front through-holes (not shown) for allowing the corresponding linearly movable cams 62 to penetrate therethrough. Each of the front through-holes is provided at a position confronting a position between the first side plate 81 and the second side plate 82. The rear plate 75 is formed with two rear through-holes (not shown) in confrontation with the two front through-holes formed in the front plate 74 in the frontward/rearward direction.

(2) Linearly Movable Cam

As shown in FIG. 3, each linearly movable cam 62 is provided with a base portion 63 and four cam portions 64.

The base portion 63 has an elongated beam shape extending in the frontward/rearward direction. The base portion 63 has a frontward/rearward length greater than a frontward/rearward distance between the front plate 74 and the rear plate 75.

The base portion 63 has a front end portion 63*a* whose lower surface is provided with second gear teeth 65 as a rack gear. A lower portion of the second gear teeth 65 is constantly exposed through the opening 84. That is, the second gear teeth 65 are in meshing engagement with the interlocking gear 87 of the side plate 72 through the opening 84.

The four cam portions 64 are integral with the base portion 63. The four cam portions 64 are provided at an upper surface of the base portion 63 and arranged spaced apart from each other. Each cam portion 64 protrudes upward from the upper surface of the base portion 63 and has a generally rectangular shape in a side view. The cam portion 64 has a front end provided with a slant surface 66 extending diagonally above and rearward from the upper surface of the base portion 63 toward an upper surface of the cam portion 64.

Further, each cam portion 64 is provided with a leaf spring 67. The leaf spring 67 is provided with a pressure portion 68 and a pair of front and rear leg portions 69. The pressure portion 68 has a plate shape extending in the frontward/rearward direction. The leg portions 69 are integral with the pressure portion 68 and fix front and rear end portions of the pressure portion 68 on the upper surface of the corresponding cam portion 64. The leaf spring 67 is fixed to the upper surface of the corresponding cam portion 64 such that the pressure portion 68 is inclined diagonally upward and rearward.

Further, the linearly movable cam 62 is slidably movable in the frontward/rearward direction between a separation position and a contact position in association with rotation of the interlocking gear 87.

That is, when one of the right and left interlocking gears 87 rotates in a counterclockwise direction in FIG. 3, the remaining one of the right and left interlocking gears 87 also rotates in the counterclockwise direction via the connection shaft 89. Each interlocking gear 87 is in meshing engagement with the second gear teeth 65 of the corresponding linearly movable cam 62. Hence, counterclockwise rotation of each interlocking gear 87 exerts a forward force on the second gear teeth 65. As a result, the right and left linearly movable cams 62 simultaneously move forward to be positioned in the contact position.

At this time, the front end portion 63*a* (FIG. 3) of each base portion 63 protrudes forward from the front plate 74 through the front through-hole (not shown). Further, each cam portion 64 is located at a position confronting the corresponding shaft supporting notch 83 formed in the first side plate 81 in the upward/downward direction. Further, each interlocking gear 87 is in meshing engagement with a rear portion of the corresponding second gear teeth 65.

When the one of the right and left interlocking gears 87 rotates in a clockwise direction in FIG. 3, the remaining one of the right and left interlocking gear 87 also rotates in the clockwise direction via the connection shaft 89. Clockwise rotation of each interlocking gear 87 exerts a rearward force on the second gear teeth 65 of the corresponding linearly movable cam 62. As a result, the right and left linearly movable cams 62 simultaneously move rearward to be positioned in the separation position.

At this time, a rear end portion of each base portion 63 protrudes rearward from the rear plate 75 through the rear through-hole (not shown). Further, each cam portion 64 is located at a position adjacent to and rearward of the corresponding shaft supporting notch 83 formed in the first side plate 81. Further, each interlocking gear 87 is in meshing engagement with a front portion of the corresponding second gear teeth 65.

(3) Process Cartridge

Each process cartridge 31 has a cartridge frame 91 formed in a top open box shape, and, within the cartridge frame 91, the photosensitive drum 32, the charger 33 (FIG. 1), and the developing unit 34 (FIG. 1) are provided.

The cartridge frame 91 has a pair of right and left side plates, each formed with a shaft supporting hole 90 at a position confronting the photosensitive drum 32 in the rightward/leftward direction.

The photosensitive drum 32 includes a cylindrical drum body 92 and flange portions 93 fixedly (non-rotatably) fitted in respective right and left ends of the drum body 92.

The drum body 92 has a top layer made from a photosensitive layer with positive charging characteristic.

Each flange portion 93 is provided with an insertion portion 94 and a shaft portion 95 integral with the insertion portion 94. The insertion portion 94 is cylindrical in shape and press-fitted in the drum body 92. The shaft portion 95 is coaxial with the insertion portion 94 and is cylindrical in shape. The shaft portion 95 has an outer diameter smaller than that of the insertion portion 94 and substantially equal to an inner diameter of the shaft supporting hole 90 formed in the cartridge frame 91.

The shaft portion 95 is supported in the shaft supporting hole 90 and rotatable relative to the cartridge frame 91.

With this configuration, the photosensitive drum 32 is supported to the cartridge frame 91 via the shaft portions 95 of the flange portions 93 and rotatable relative to the cartridge frame 91.

Further, as shown in FIG. 5, the black process cartridges 31K is integrally provided with a belt cleaning unit 96 at a position frontward of the developing unit 34. The belt cleaning unit 96 is adapted for cleaning the intermediate transfer belt 22.

4. Mounting Operation of Process Cartridge Relative to Process Unit

Figure 4:
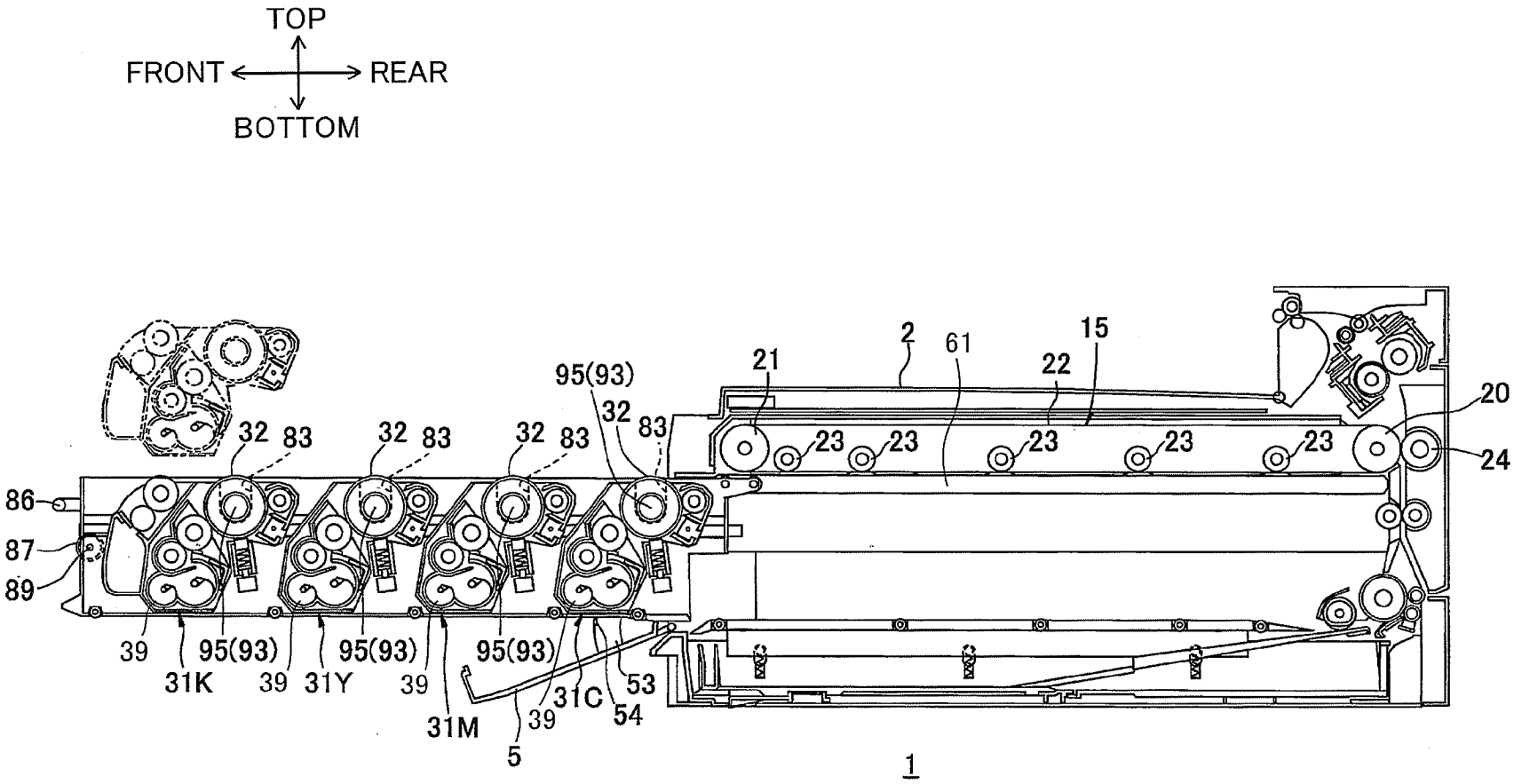
FIG. 4 is a cross-sectional side view of the color printer shown in FIG. 1, illustrating removal and mounting operations of a process cartridge relative to the process unit.

As shown in FIG. 4, a mounting operation of the process cartridges 31 relative to the process unit 17 is performed when the process unit 17 is in the external position where the process unit 17 is pulled outward of the main casing 2.

At this time, the front cover 5 is in the open position where the upper end (free end) of the front cover 5 is spaced apart from the main casing 2 and inclined forward and downward.

Further, each interlocking gear 87 is in meshing engagement with the front portion of the corresponding second gear teeth 65, and the linearly movable cam 62 is in the separation position.

Initially, the process cartridge 31 is positioned above the process unit 17. The process cartridge 31 has a posture such that the photosensitive drum 32 is positioned above the toner accommodating section 39.

Then, the process cartridge 31 is moved downward, so that the process cartridge 31 enters between the right and left side plates 72 of the process frame 71. When the process cartridge 31 is further moved downward, the shaft portions 95 of the flange portions 93 provided in the photosensitive drum 32 are inserted into the shaft supporting notches 83 formed in the first side plates 81 of the right and left side plates 72, and brought into abutment with the lower portions of the shaft supporting notches 83, respectively. Abutment of the shaft portions 95 with the lower portions of the shaft supporting notches 83 restricts further downward movement of the process cartridge 31. As a result, mounting of the process cartridge 31 in the process unit 17 is completed.

When the process cartridge 31 has been mounted in the process unit 17, each shaft portion 95 of the flange portion 93 is positioned such that a distal end portion of the shaft portion 95 is located between the first side plate 81 and the second side plate 82, that is, located above the support portion 88.

5. Mounting Operation of Process Unit Relative to Main Casing

As shown in FIGS. 4 and 5, a mounting operation of the process unit 17 relative to the main casing 2 is performed when all four process cartridges 31 have been mounted in the process unit 17. That is, when all four process cartridges 31 have been mounted in the process unit 17, the process unit 17 is moved to the internal position from the external position.

When the process unit 17 is in the external position, the rollers 85 of each second side plate 82 of the side plate 72 are positioned in the front end portion of the corresponding guide groove 61 formed in the inner casing 51.

Initially, the user holds the handle 86 of the process unit 17 to move the process unit 17 rearward. At this time, the rollers 85 are guided along the corresponding guide grooves 61 to be moved rearward. Then, when the process unit 17 is moved rearward until the rear side rollers 85 reach rear ends of the corresponding guide grooves 61, further rearward movement of the process unit 17 is restricted. As a result, movement of the process unit 17 to the internal position has been completed.

At this time, the flange portions 93 of each photosensitive drum 32 is positioned below and spaced apart from the drum positioning recesses 59 formed in the first frames 55.

6. Pressure Operation of Linearly Movable Cam

Figure 6:
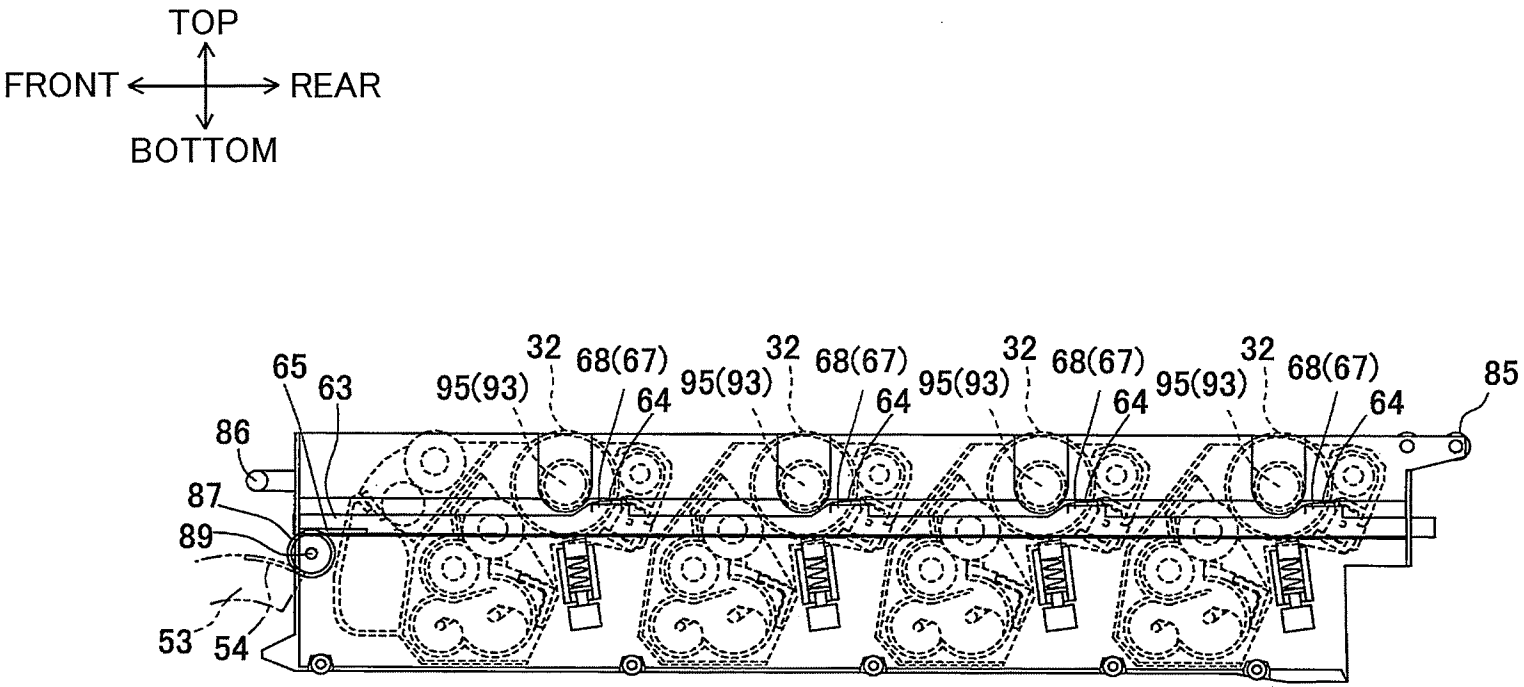
FIG. 6 is a cross-sectional side view of the process unit, illustrating a pressure operation of a linearly movable cam in a state where a front cover is being moved to a closed position.
Figure 7:
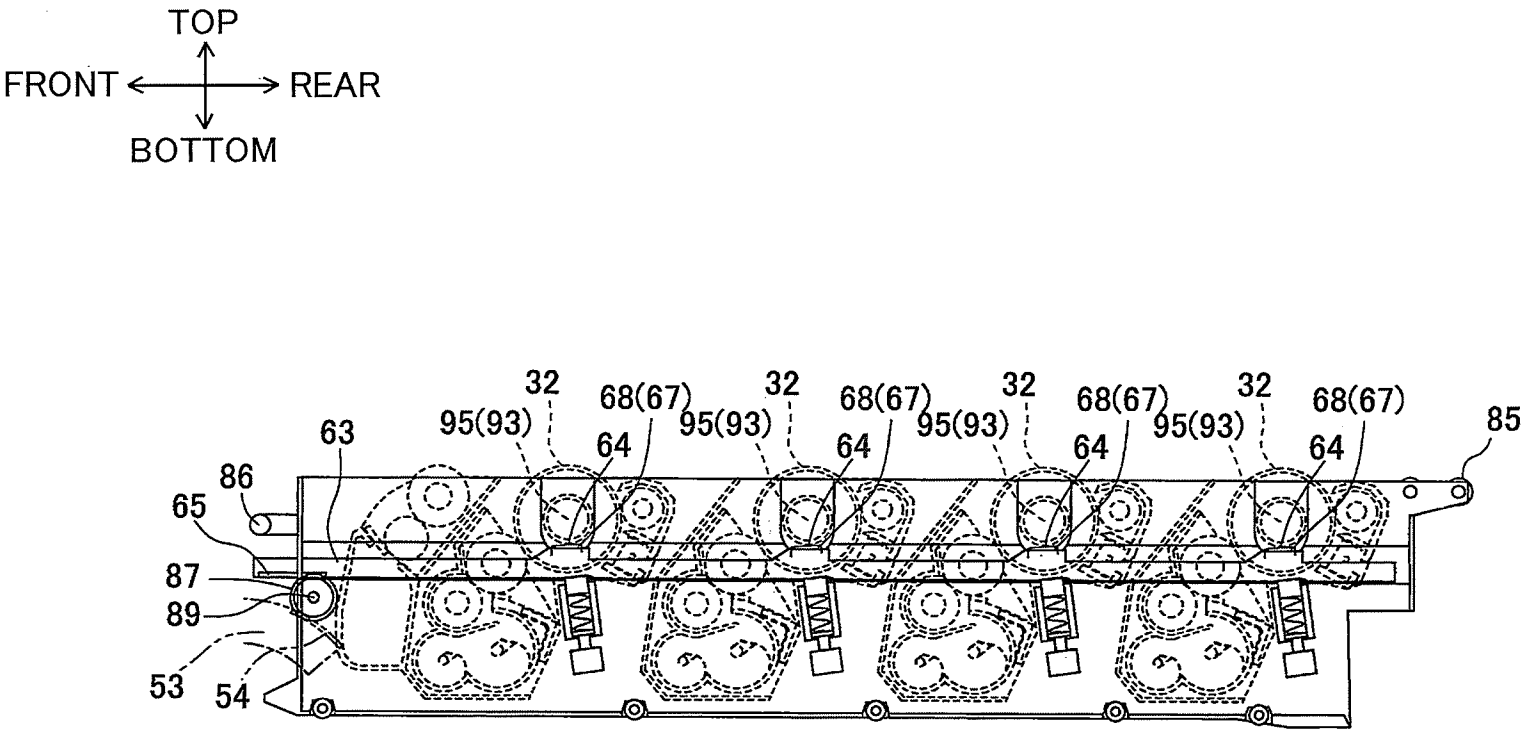
FIG. 7 is a cross-sectional side view of the process unit, illustrating the pressure operation of the linearly movable cam in a state where the front cover is in the closed position.

Next, the front cover 5 is pivotally moved toward the closed position from the open position. Pivotal movement of the front cover 5 toward the closed position brings the first gear teeth 54 of the interlocking member 53 into meshing engagement with a lower portion of the left interlocking gear 87, as shown in FIG. 6.

Then, when the front cover 5 is further moved toward the closed position, the interlocking member 53 is moved substantially rearward. Rearward movement of the interlocking member 53 allows one interlocking gear 87 in meshing engagement with the first gear teeth 54 to rotate in the counterclockwise direction in FIG. 6. Simultaneously, the remaining interlocking gear 87 also rotates in the counterclockwise direction via the connection shaft 89. As a result, the right and left linearly movable cams 62 are moved forward toward the contact position from the separation position.

Then, the slant surface 66 of each cam portion 64 is brought into abutment with the shaft portion 95 of the corresponding photosensitive drum 32, which is inserted into the corresponding shaft supporting notch 83, from the rear. In association with forward movement of the linearly movable cam 62, each shaft portion 95 is moved upward along the slant surface 66, thereby separating from the lower portion of the corresponding shaft supporting notch 83. As a result, each process cartridge 31 is entirely lifted upward via the flange portions 93.

Further pivotal movement of the front cover 5 positions the front cover 5 in the closed position, and further moves the right and left linearly movable cams 62 forward. As a result, the right and left linearly movable cams 62 are moved to the contact position.

At this time, each shaft portion 95 is seated upon the corresponding cam portion 64. Consequently, each flange portion 93 is brought into abutment with the corresponding drum positioning recess 59. Further, the leaf spring 67 provided at the upper surface of the cam portion 64 resiliently urges the shaft portion 95 upward, thereby bringing the flange portion 93 into resilient contact with the first frame 55.

As a result, the surface of the photosensitive drum 32 is brought into contact with the intermediate transfer belt 22 of the belt unit 15 from below, thereby positioning the photosensitive drum 32 relative to the belt unit 15.

Pressure from the cam portion 64 relative to the photosensitive drum 32 can be released by performing the above-described pressure operation in reverse order. When the front cover 5 is pivotally moved toward the open position from the closed position, one interlocking gear 87 in meshing engagement with the first gear teeth 54 of the interlocking member 53 rotates in the clockwise direction in FIG. 7. Simultaneously, the remaining interlocking gear 87 also rotates in the clockwise direction via the connection shaft 89. Clockwise rotation of each interlocking gear 87 exerts a rearward force on the second gear teeth 65. Accordingly, the right and left linearly movable cams 62 are simultaneously moved rearward. As a result, each shaft portion 95 is moved downward along the slant surface 66 so as to be separated from the corresponding first frame 55.

Hence, pressure application from the cam portion 64 to the corresponding photosensitive drum 32 is released. After pressure application from the cam portions 64 to the photosensitive drums 32 has been released, the user holds the handle 86 of the process unit 17 to draw the process unit 17 to the external position.

7. Operations and Effects (1) According to the color printer 1, when the process unit 17 is in the internal position, the shaft portion 95 of each flange portion 93 of the photosensitive drum 32 is pressed upward by the leaf spring 67 of the corresponding cam portion 64 of the linearly movable cam 62 by moving the linearly movable cam 62 to the contact position. With this configuration, each photosensitive drum 32 is pressed upward toward the belt unit 15, thereby bringing the photosensitive drum 32 into contact with the intermediate transfer belt 22 of the belt unit 15.

Further, each linearly movable cam 62 is provided in the process unit 17 in which the photosensitive drums 32 are supported. Hence, pressure application from the linearly movable cams 62 to the photosensitive drums 32 is reliably attained.

Further, for example, in case that a linearly movable cam is not provided in a process unit, an opening needs to be formed in the process unit in order to press a flange portion by a leaf spring provided at the linearly movable cam. However, in the above-described embodiment, the linearly movable cam 62 is provided in the process unit 17. Therefore, it is not necessary to form an opening in the process unit 17. Accordingly, the strength of the process unit 17 can be maintained.

As a result, in the configuration that the photosensitive drum 32 is positioned below the belt unit 15, positioning of the photosensitive drum 32 relative to the intermediate transfer belt 22 and stable contact between the photosensitive drum 32 and the intermediate transfer belt 22 can be attained.

(2) The photosensitive drum 32 is provided with the flange portions 93 protruding laterally outward through the shaft supporting notches 83 formed in the first side plates 81 of the side plates 72. Thus, when each linearly movable cam 62 is in the contact position, both of the right and left flange portions 93 of the photosensitive drum 32 can be pressed upward. Accordingly, the right and left linearly movable cams 62 exert a pressure force on the right and left flange portions 93 uniformly, thereby transmitting the uniform pressure force to the photosensitive drum 32 in the rightward/leftward direction.

(3) Each linearly movable cam 62 is slidably linearly movable in the frontward/rearward direction. Accordingly, all of the leaf springs 67 corresponding to the respective photosensitive drums 32 can be simultaneously moved.

(4) Each side plate 72 has the first side plate 81 and the second side plate 82. Further, each linearly movable cam 62 is positioned between the first side plate 81 and the second side plate 82. Further, each flange portion 93 protrudes laterally outward toward the second side plate 82 through the first side plate 81. Therefore, the linearly movable cam 62 can easily press each flange portion 93 of the photosensitive drum 32 supported in the shaft supporting notch 83 formed in the first side plate 81.

(5) Further, each linearly movable cam 62 is supported on the support portion 88. Accordingly, the linearly movable cam 62 can be moved smoothly in the frontward/rearward direction along the support portion 88.

Further, the linearly movable cam 62 might be bent due to counteraction of the leaf spring 67. However, the linearly movable cam 62 is mounted on the support portion 88, thereby preventing the linearly movable cam 62 from being bent.

(6) Further, each second side plate 82 is provided with the rollers 85. Therefore, when the process unit 17 is moved between the internal position and the external position, the rollers 85 attain smooth movement of the process unit 17.

(7) Further, the front cover 5 is provided with the interlocking member 53 for moving the linearly movable cams 62 between the separation position and the contact position in association with pivotal movement of the front cover 5 between the open position and the closed position. With a simple movement of the front cover 5 between the open position and the closed position, the first gear teeth 54 of the interlocking member 53 can be brought into meshing engagement with the second gear teeth 65 of the linearly movable cam 62 to move the linearly movable cam 62.

(8) Further, each cam portion 64 has the leaf spring 67. With a simple configuration, each photosensitive drum 32 can be brought into contact with the intermediate transfer belt 22.

In a conventional art, in order to avoid frictional contact between the photosensitive drum 32 of the process unit 17 and the intermediate transfer belt 22, the process unit 17 is positioned below and spaced apart from the belt unit 15 when moving, and the process unit 17 is entirely lifted upward to bring the photosensitive drum 32 into contact with the intermediate transfer belt 22 after the process unit 17 has reached the internal position.

However, in this case, for entirely lifting the process unit 17 upward against gravity, application of a greater force is required. Hence, operability is degraded.

In comparison with the conventional art, in the above-described embodiment, only the process cartridge 31 is lifted upward to bring the photosensitive drum 32 into contact with the intermediate transfer belt 22 after the process unit 17 has been horizontally moved. Therefore, in the configuration such that the process unit 17 is positioned below the belt unit 15, operability in positioning the photosensitive drums 32 relative to the belt unit 15 can be greatly improved.

Further, in a conventional color printer, there is a defect such that a process cartridge is required to be constantly urged upward, otherwise a photosensitive drum frictionally contacts a belt unit when a process unit is inserted into a main casing. In comparison with this conventional art, in the above-described embodiment, the process cartridge 31 is provided at a position spaced apart from the belt unit 15 (i.e. below the belt unit 15) by virtue of gravity. Hence, an urging unit for constantly urging the process cartridge 31 upward can be omitted.

8. Second Embodiment

Figure 8A:
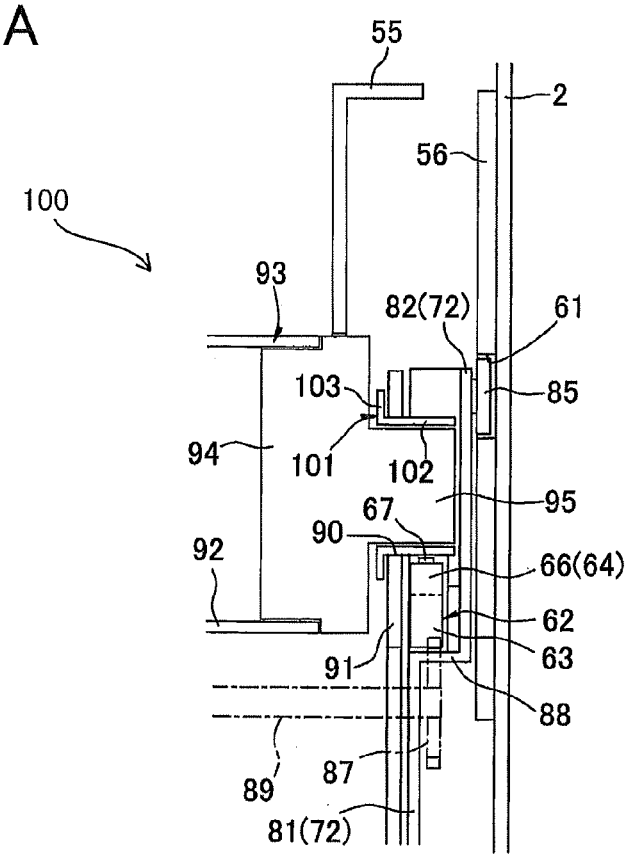
FIG. 8A is a cross-sectional view of an essential portion of a pressure mechanism provided in a color printer according to a second embodiment of the present invention.

A color printer 100 according to a second embodiment of the present invention will be described while referring to FIG. 8A. In the following description, only parts differing from those of the above-described embodiment will be described.

In the first embodiment, each flange portion 93 of the photosensitive drum 32 is rotatably supported in the shaft supporting hole 90 formed in the cartridge frame 91 of the process cartridge 31. However, in the second embodiment, a shaft supporting member 101 is interposed between the flange portion 93 and the shaft supporting hole 90.

The shaft supporting member 101 has a cylindrical insertion portion 102 and an annular flange portion 103. The flange portion 103 is integral with the insertion portion 102 and extends radially outwardly from one end of the insertion portion 102.

The insertion portion 102 has an inner diameter substantially equal to an outer diameter of the shaft portion 95 of the flange portion 93. Further, the insertion portion 102 has an outer diameter substantially equal to an inner diameter of the shaft supporting hole 90 formed in the cartridge frame 91.

The flange portion 103 has an outer diameter greater than the inner diameter of the shaft supporting hole 90.

The shaft portion 95 of the flange portion 93 is fitted into the insertion portion 102 and rotatable relative to the insertion portion 102. The flange portion 103 is positioned at a base end side of the shaft portion 95 (at an insertion portion 94 side). The insertion portion 102 of the shaft supporting member 101 is fitted into the shaft supporting hole 90 formed in the cartridge frame 91. The insertion portion 102 is not rotatable relative to the shaft supporting hole 90.

When the process cartridge 31 has been mounted in the process unit 17 (FIG. 5), a laterally outer end of each insertion portion 102 of the shaft supporting member 101 is positioned between the first side plate 81 and the second side plate 82 in the rightward/leftward direction.

In association with pivotal movement of the front cover 5 to the closed position form the open position, each linearly movable cam 62 is moved forward, thereby bringing each cam portion 64 into abutment with the corresponding insertion portion 102 from rear. Hence, the insertion portion 102 moves upward along the slant surface 66. Further, the insertion portion 102 is resiliently pressed upward by the leaf spring 67. As a result, the process cartridge 31 is entirely moved upward via the shaft supporting member 101.

When the front cover 5 is moved to the closed position, each flange portion 93 is brought into abutment with the corresponding drum positioning recess 59, so that the photosensitive drum 32 contacts the intermediate transfer belt 22 of the belt unit 15 from below. As a result, positioning of the photosensitive drum 32 relative to the belt unit 15 can be attained.

Hence, the second embodiment provides function and effect similar to that of the first embodiment.

Further, the shaft supporting member 101 is supported to the cartridge frame 91 but not rotatable relative to the cartridge frame 91, and the leaf spring 67 presses the shaft supporting member 101. Thus, when forming an image, frictional contact between the leaf spring 67 and the shaft supporting member 101 can be avoided while the photosensitive drum 32 rotates.

9. Third Embodiment

Figure 8B:
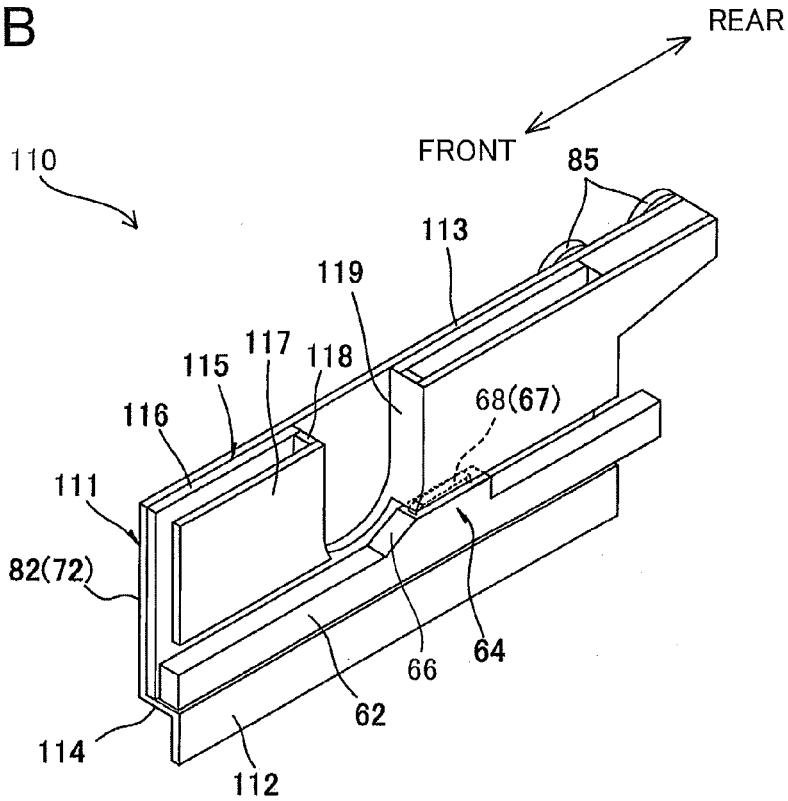
FIG. 8B is a perspective view of an essential portion of a process unit of a color printer according to a third embodiment of the present invention.

A color printer 110 according to a third embodiment of the present invention will be described while referring to FIG. 8B. In the following description, only parts differing from those of the above-described embodiment will be described.

A side plate 111 of the color printer 110 of the third embodiment includes a first side plate 112, a second side plate 113, a support portion 114, and a shaft supporting assembly 115.

The first and second side plates 112 and 113 are flat plate shaped extending in the frontward/rearward direction and in the upward/downward direction. The second side plate 113 has a lower edge in confrontation with an upper edge of the first side plate 112 and positioned laterally outward of the upper edge.

The rollers 85 are supported to the second side plate 112. More specifically, roller shafts (not shown) extend laterally outward from a laterally outer surface of the second side plate 112 at an upper rear end portion thereof, and rollers 85 are rotatable about the roller shafts.

The support portion 114 is flat plate shaped and is connected to the lower edge of the second side plate 113 and the upper edge of the first side plate 112.

Thus, a combination of the first and second side plates 112, 113 and the support portion 114 constitute a crank-shaped profile in a front view. The linearly movable cam 62 is mounted on the support portion 114.

The shaft supporting assembly 115 includes a third side plate 116 extending along the laterally inner surface of the second side plate 113, a fourth side plate 117 positioned laterally inward of and in confrontation with the third side plate 116, and a plurality of connecting plates 118.

The third and fourth side plates 116 and 117 have frontward/rearward lengths and vertical lengths approximately the same as those of the second side plate 113. A shaft supporting notch 119 having generally U-shape in side view is formed in the third and fourth side plates 116, 117, such that an open end of "U" is at an upper edge of the third and fourth side plates 116, 117. The position of the notch 119 corresponds to the position of the photosensitive drum 32.

Each connection plate 118 is provided for each shaft supporting notch 119, and extends along the U-shaped notch 119 such that the one longitudinal edge of each connection plate 118 extends along the U-shaped notch of the third side plate 116 and another longitudinal edge of each connection plate extends along the U-shaped notch of the fourth side plate 117.

Further, a lower end portion of the fourth side plate 117 and a lower end portion of each connecting plate 118 are cut away so as to prevent the linearly movable cam 62 mounted on the support portion 114 from being interfered with these lower end portions.

The third embodiment provides function and effect similar to that of the first embodiment. Further, the first side plate 112 and the second side plate 113 are not positioned laterally beside the linearly movable cam 62. Therefore, frictional force to be applied to the linearly movable cam 62 can be reduced, thereby attaining smooth movement of the linearly movable cam 62.

While the present invention has been described in detail with reference to the present embodiments thereof, it would be apparent to those skilled in the art that various changes and modifications may be made therein without departing from the spirit of the present invention.

What is claimed is:

1. An image forming apparatus comprising a main casing;

a retaining unit configured to retain a plurality of photosensitive drums juxtaposedly arrayed with and spaced away from each other in a predetermined direction, the retaining unit being movable in the predetermined direction between an internal position within the main casing and an external position outside of the main casing, each of the plurality of photosensitive drums being movably supported on the retaining unit in a vertical direction and including a pressed portion;

an endless belt disposed above the retaining unit that is in the internal position; and a moving member including a plurality of pressing portions each of which presses the pressed portion of a corresponding one of the plurality of photosensitive drums, the moving member being configured to be moved between a contact position and a separated position when the retaining unit is in the internal position, each of the plurality of pressing portions exerting upward pressure on the corresponding one of the plurality of photosensitive drums to bring the corresponding one of the plurality of photosensitive drums into contact with the endless belt when the moving member is in the contact position, each of the plurality of pressing portions releasing the upward pressure on the corresponding one of the plurality of photosensitive drums to separate the corresponding one of the plurality of photosensitive drums from the endless belt when the moving member is in the separated position, wherein the moving member is provided inside the retaining unit wherein each of the plurality of photosensitive drums has an axis extending in an axial direction and end portions in the axial direction, wherein the retaining unit includes a pair of side plate portions each of which is located on each of the end portions, each of the pair of side plate portions including a plurality of receiving portions each of which configured to receive the corresponding one of the plurality of photosensitive drums to be movable in the vertical direction, wherein each of the pressed portions protrudes outward from a corresponding one of the plurality of receiving portions in the axial direction, wherein the moving member is configured to exert upward pressure on the pressed portions of the plurality of photosensitive drums when the moving member is in the contact position, wherein each of the pair of side plate portions includes a first plate formed with the plurality of receiving portions and a second plate located outward of the first plate, and wherein the moving member is located between the first plate and the second plate.

2. The image forming apparatus according to claim 1, wherein the moving member is a linearly movable cam that is configured to be linearly movable in the predetermined direction.

3. The image forming apparatus according to claim 1, wherein each of the pair of side plate portions further includes a support portion extending from the first plate to the second plate in the axial direction, and wherein the moving member is placed on the support portion.

4. The image forming apparatus according to claim 1, wherein each of the second plate includes an outer surface provided with a guide portion, and wherein the guide portion is configured to guide movement of the retaining unit between the internal position and the external position.

5. The image forming apparatus according to claim 1, wherein the main casing includes a side wall formed with an opening that provides communication between an interior and exterior of the main casing, and further comprising an opening/closing member having one end portion and configured to be pivotally moved between an open position in which the one end portion is spaced apart from the main casing to open the opening and a closed position in which the one end portion is in abutment with the main casing to close the opening, wherein the moving member includes an exposed portion positioned on an opening/closing member side in the predetermined direction, the exposed portion being exposed from the retaining unit when the retaining unit is in the internal position and being formed with a gear teeth, and wherein the opening/closing member is provided with an interlocking member, the interlocking member being configured to be in meshing engagement with the gear teeth to move the moving member from the separated position to the contact position in association with pivotal movement of the opening/closing member from the open position to the closed position.

6. The image forming apparatus according to claim 1, wherein each of the plurality of pressing portions is a leaf spring.

7. The image forming apparatus according to claim 1, wherein each of a plurality of photosensitive drums is detachable from the retaining unit when the retaining unit is in the external position.

8. An image forming apparatus comprising a main casing;

a retaining unit configured to retain a plurality of photosensitive drums juxtaposedly arrayed with and spaced away from each other in a predetermined direction, the retaining unit being movable in the predetermined direction between an internal position within the main casing and an external position outside of the main casing, each of the plurality of photosensitive drums being movably supported on the retaining unit in a vertical direction and including a pressed portion;

an endless belt disposed above the retaining unit that is in the internal position; and a moving member including a plurality of pressing portions each of which presses the pressed portion of a corresponding one of the plurality of photosensitive drums, the moving member being configured to be moved between a contact position and a separated position when the retaining unit is in the internal position, each of the plurality of pressing portions exerting upward pressure on the corresponding one of the plurality of photosensitive drums to bring the corresponding one of the plurality of photosensitive drums into contact with the endless belt when the moving member is in the contact position, each of the plurality of pressing portions releasing the upward pressure on the corresponding one of the plurality of photosensitive drums to separate the corresponding one of the plurality of photosensitive drums from the endless belt when the moving member is in the separated position, wherein the moving member is provided on the retaining unit, wherein each of the plurality of photosensitive drums has an axis extending in an axial direction and end portions in the axial direction, wherein the retaining unit includes a pair of side plate portions each of which is located on each of the end portions, each of the pair of side plate portions including a plurality of receiving portions each of which configured to receive the corresponding one of the plurality of photosensitive drums to be movable in the vertical direction, wherein each of the pressed portions protrudes outward from a corresponding one of the plurality of receiving portions in the axial direction, wherein the moving member is configured to exert upward pressure on the pressed portions of the plurality of photosensitive drums when the moving member is in the contact position, wherein each of the pair of side plate portions includes a first plate formed with the plurality of receiving portions and a second plate located outward of the first plate, and wherein the moving member is located between the first plate and the second plate.

9. The image forming apparatus according to claim 8, wherein the moving member is a linearly movable cam that is configured to be linearly movable in the predetermined direction.

10. The image forming apparatus according to claim 8, wherein each of the pair of side plate portions further includes a support portion extending from the first plate to the second plate in the axial direction, and wherein the moving member is placed on the support portion.

11. The image forming apparatus according to claim 8, wherein each of the second plate includes an outer surface provided with a guide portion, and wherein the guide portion is configured to guide movement of the retaining unit between the internal position and the external position.

12. The image forming apparatus according to claim 8, wherein the main casing includes a side wall formed with an opening that provides communication between an interior and exterior of the main casing, and further comprising an opening/closing member having one end portion and configured to be pivotally moved between an open position in which the one end portion is spaced apart from the main casing to open the opening and a closed position in which the one end portion is in abutment with the main casing to close the opening, wherein the moving member includes an exposed portion positioned on an opening/closing member side in the predetermined direction, the exposed portion being exposed from the retaining unit when the retaining unit is in the internal position and being formed with a gear teeth, and wherein the opening/closing member is provided with an interlocking member, the interlocking member being configured to be in meshing engagement with the gear teeth to move the moving member from the separated position to the contact position in association with pivotal movement of the opening/closing member from the open position to the closed position.

13. The image forming apparatus according to claim 8, wherein each of the plurality of pressing portions is a leaf spring.

14. The image forming apparatus according to claim 8, wherein each of a plurality of photosensitive drums is detachable from the retaining unit when the retaining unit is in the external position.

15. An image forming apparatus comprising a main casing;

a retaining unit configured to retain a plurality of photosensitive drums juxtaposedly arrayed with and spaced away from each other in a predetermined direction, the retaining unit being movable in the predetermined direction between an internal position within the main casing and an external position outside of the main casing, each of the plurality of photosensitive drums being movably supported on the retaining unit in a vertical direction, each of the plurality of photosensitive drums having an axis extending in an axial direction and end portions in the axial direction;

an endless belt disposed above the retaining unit that is in the internal position; and a moving unit including a plurality of pressing portions each of which presses each of the end portions of a corresponding one of the plurality of photosensitive drums, the moving unit being configured to be moved between a contact position and a separated position when the retaining unit is in the internal position, each of the plurality of pressing portions exerting upward pressure on each of the end portions of the corresponding one of the plurality of photosensitive drums to bring the corresponding one of the plurality of photosensitive drums into contact with the endless belt when the moving unit is in the contact position, each of the plurality of pressing portions releasing the upward pressure on each of the end portions of the corresponding one of the plurality of photosensitive drums to separate the corresponding one of the plurality of photosensitive drums from the endless belt when the moving unit is in the separated position, wherein the moving unit is provided on the retaining unit, and wherein each of the plurality of pressing portions is a spring.

16. The image forming apparatus according to claim 15, wherein the retaining unit includes a pair of side plate portions each of which is located on each of the end portions, each of the pair of side plate portions including a plurality of receiving portions each of which is configured to receive the corresponding one of the plurality of photosensitive drums to be movable in the vertical direction, wherein each of the end portions protrudes outward from a corresponding one of the plurality of receiving portions in the axial direction, and wherein the moving unit is configured to exert upward pressure on the end portions of the plurality of photosensitive drums when the moving unit is in the contact position.

17. The image forming apparatus according to claim 16, wherein each of the pair of side plate portions includes a first plate formed with the plurality of receiving portions and a second plate located outward of the first plate, and wherein the moving unit is located between the first plate and the second plate.

18. The image forming apparatus according to claim 17, wherein each of the pair of side plate portions further includes a support portion extending from the first plate to the second plate in the axial direction, and wherein the moving unit is placed on the support portion.

19. The image forming apparatus according to claim 17, wherein each of the second plate includes an outer surface provided with a guide portion, and wherein the guide portion is configured to guide movement of the retaining unit between the internal position and the external position.

20. The image forming apparatus according to claim 15, wherein the moving unit is a linearly movable cam that is configured to be linearly movable in the predetermined direction.

21. The image forming apparatus according to claim 15, wherein the main casing includes a side wall formed with an opening that provides communication between an interior and exterior of the main casing, and further comprising an opening/closing member having one free end and configured to be pivotally moved between an open position in which the one free end is spaced apart from the main casing to open the opening and a closed position in which the one free end is in abutment with the main casing to close the opening, wherein the moving unit includes an exposed portion positioned on an opening/closing member side in the predetermined direction, the exposed portion being exposed from the retaining unit when the retaining unit is in the internal position and being formed with a-gear teeth, and wherein the opening/closing member is provided with an interlocking member, the interlocking member being configured to be in meshing engagement with the gear teeth to move the moving unit from the separated position to the contact position in association with pivotal movement of the opening/closing member from the open position to the closed position.

22. The image forming apparatus according to claim 15, wherein each of a plurality of photosensitive drums is detachable from the retaining unit when the retaining unit is in the external position.

* * * * *